US005795028A

United States Patent [19]

Dussia, Jr. et al.

[11] Patent Number: 5,795,028

[45] Date of Patent: Aug. 18, 1998

[54] MODULAR CHAIR AND METHOD

[75] Inventors: Ralph J. Dussia, Jr., Lasalle; Gerald E. Roberts, Monroe; Margaret A. Hoffman, So. Rockwood, all of Mich.; William A. Calvert, Jr., Elmore, Ohio; Duane T. Dutkievic, Monroe, Mich.; Charles R. West, Monroe, Mich.; Adam E. Thayer, Monroe, Mich.

[73] Assignee: La-Z-Boy Incorporated, Monroe, Mich.

[21] Appl. No.: 633,427

[22] Filed: Apr. 17, 1996

[51] Int. Cl.[6] ..... A47C 7/00

[52] U.S. Cl. ..... 297/440.14; 297/440.15; 297/344.21; 297/259.1; 248/220.1

[58] Field of Search ..... 297/440.14, 85, 297/344.21, 344.26, 452.52, 452.58, 452.59, 440.1, 440.15, 258.1, DIG. 7, 259.1; 248/220.1, 300

[56] References Cited

U.S. PATENT DOCUMENTS

| | | | |
|---|---|---|---|
| 210,500 | 12/1878 | Clough | 297/440.15 X |
| 939,005 | 11/1909 | Goedeke | 248/220.1 X |
| 2,656,550 | 10/1953 | Loeb . | |
| 3,030,146 | 4/1962 | Faxon | 297/440.1 X |
| 3,658,382 | 4/1972 | Anderson | 297/440.15 X |
| 3,685,063 | 8/1972 | Morgan | 297/452.59 X |
| 3,692,265 | 9/1972 | Barriger | 248/220.1 |
| 4,067,073 | 1/1978 | Komarov . | |
| 4,311,337 | 1/1982 | Brunn . | |
| 4,395,071 | 7/1983 | Laird . | |
| 4,435,103 | 3/1984 | Becker et al. . | |
| 4,815,717 | 3/1989 | Crosby . | |
| 4,828,324 | 5/1989 | Putnam . | |
| 4,844,541 | 7/1989 | Laird . | |
| 4,861,101 | 8/1989 | Hartline . | |
| 4,919,485 | 4/1990 | Guichon . | |
| 5,000,512 | 3/1991 | Laird . | |
| 5,120,107 | 6/1992 | Rogens, Jr. | 297/85 X |
| 5,277,476 | 1/1994 | Caldwell . | |
| 5,658,049 | 8/1997 | Adams et al. | 297/440.23 |

*Primary Examiner*—Milton Nelson, Jr.
*Attorney, Agent, or Firm*—Harness, Dickey & Pierce, P.L.C.

[57] ABSTRACT

A modular occasional chair and method for assembling a modular chair are disclosed. The modular chair includes a universal seat deck to which modular side frame and seat back components constructed in various styles are attached. The universal seat deck can accommodate a variety of bases including four-leg, swivel/glider, swivel, and swivel/rocker styles. The construction method involves assembling and preupholstering each modular frame component prior to final assembly. The method further involves producing a modular chair in a "cell manufacturing" environment in which the individual components are simultaneously manufactured during parallel assembly processes.

30 Claims, 7 Drawing Sheets

FIG IA
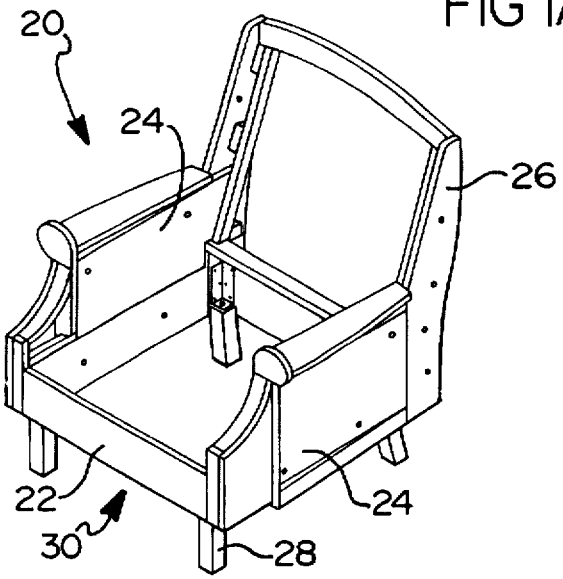
FIG IB
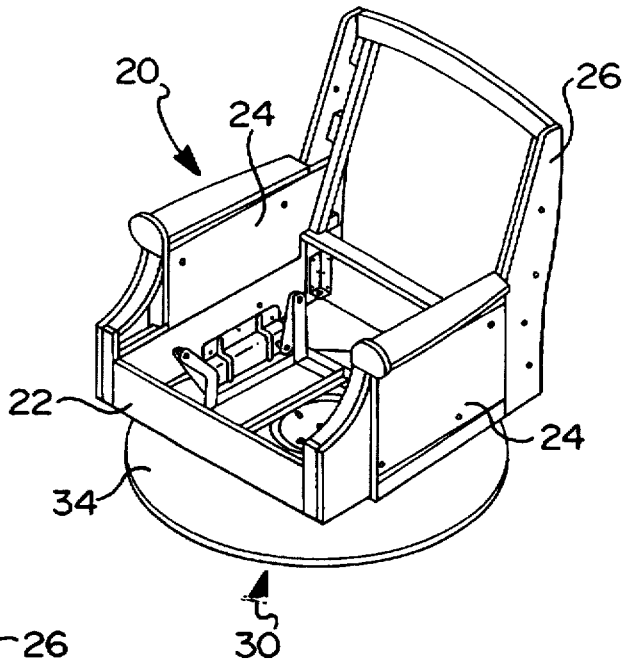
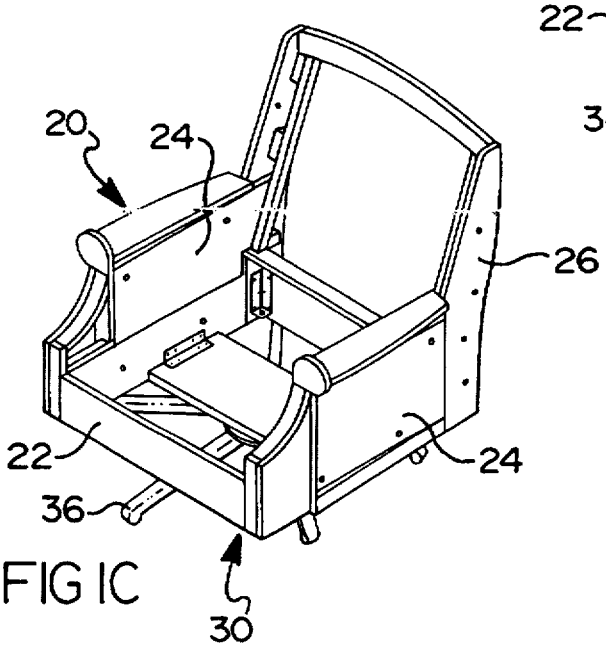
FIG IC
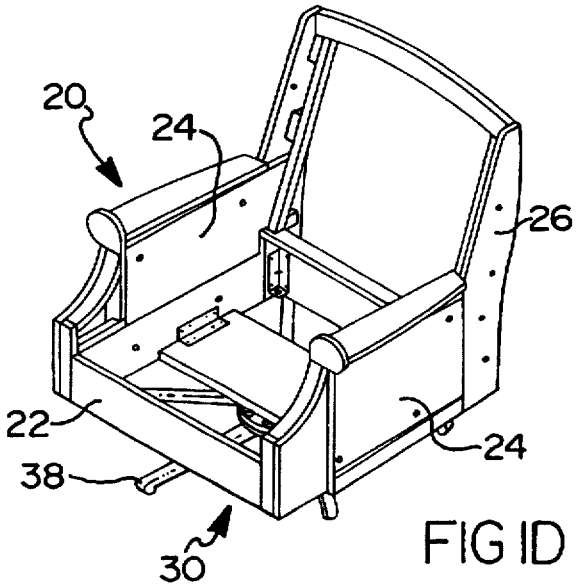
FIG ID

FIG 2
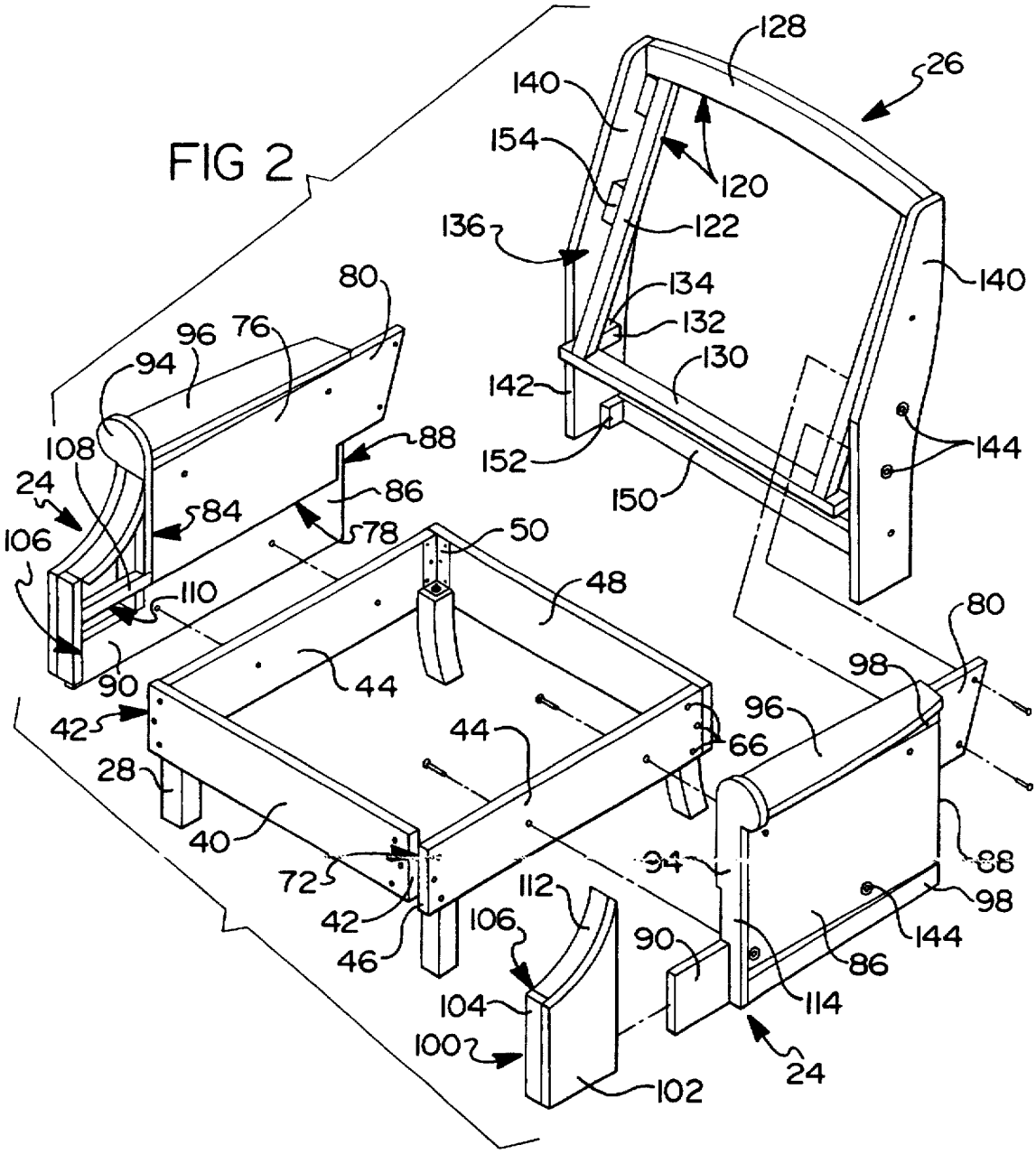
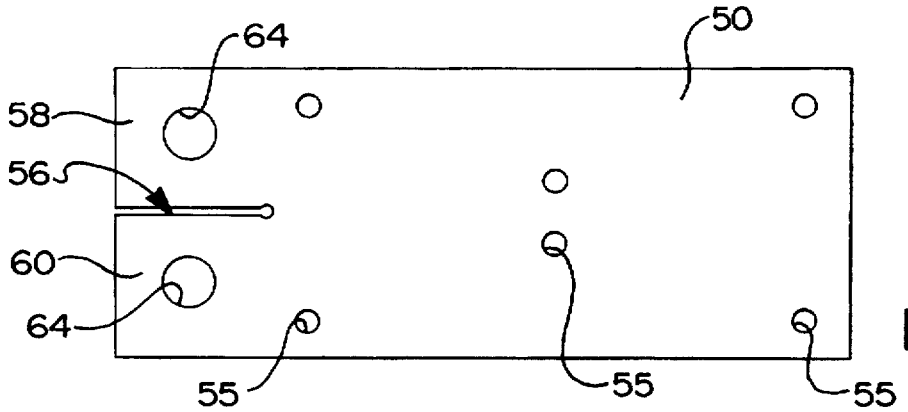
FIG 3A

FIG 3B
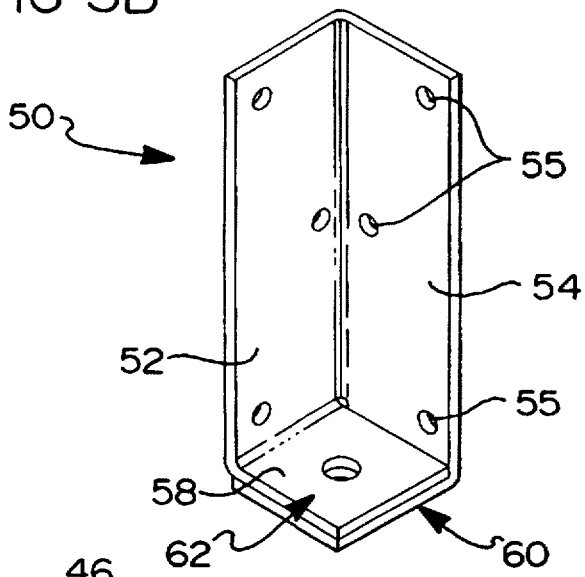
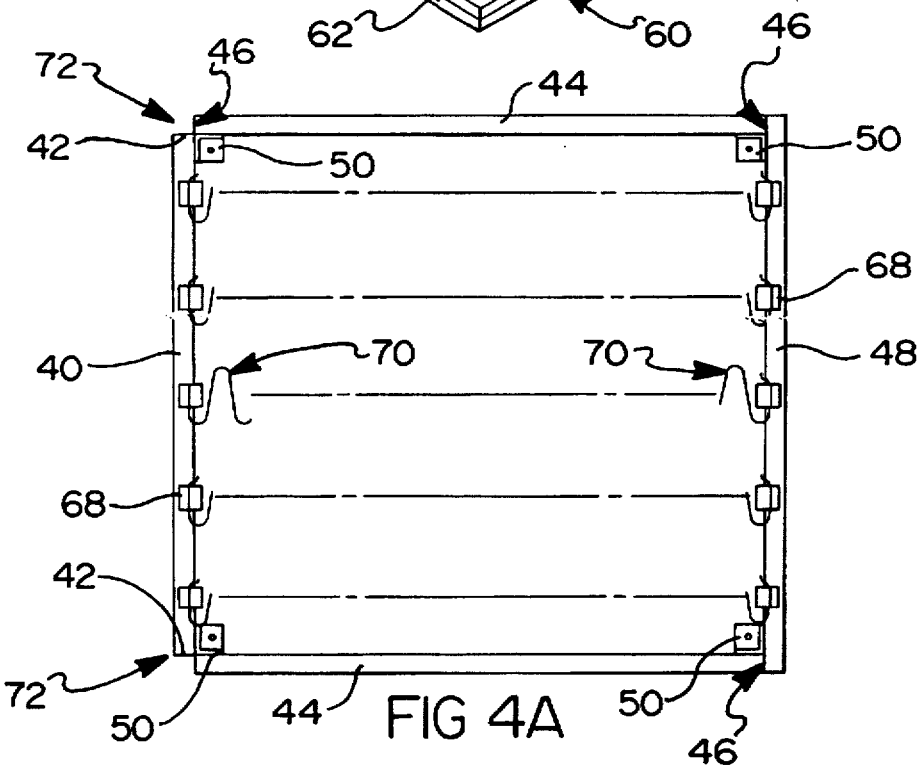
FIG 4A
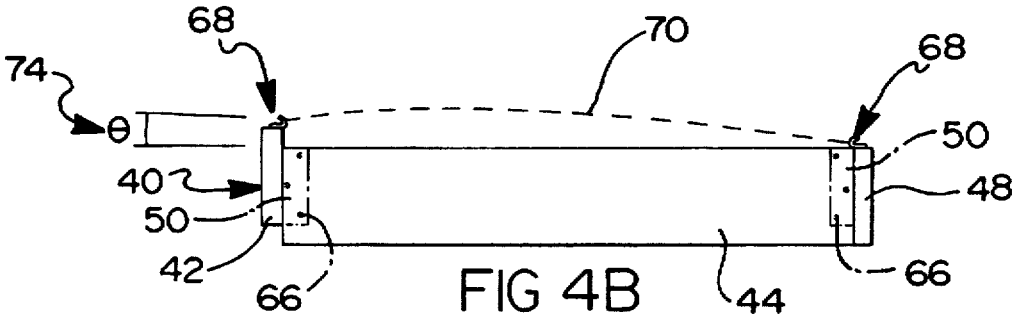
FIG 4B 6B
6B

MODULAR CHAIR AND METHOD

BACKGROUND OF THE INVENTION

1. Technical Field

The present invention relates generally to a series of modular occasional chairs formed from a universal seat deck, to an improved method for assembling the modular occasional chair from preassembled and preupholstered modular components.

2. Description of Related Art

Occasional chairs are well known in the art. These chairs can be found in a variety of styles, for example, side chairs, upholstered club-style chairs, and chairs incorporating various motion features including gliding, swiveling and/or rocking. The styling of the chair is usually dictated by the chair frame design and upholstery features; each style of chair typically having a unique chair frame. Minor changes in the chair's styling usually require significant modifications to the chair's frame. Thus, conspicuously absent from the art is a high quality and low cost occasional chair having a variety of styles which can be manufactured from preassembled modules attached to a universal frame thus offering a wide variety of styling changes.

Traditionally, occasional chairs are constructed from a single integrated chair frame. The frame is typically constructed from selected furniture grade hardwoods requiring custom manufacturing techniques. These furniture grade hardwoods, which must be free of minor imperfections, significantly increase the overall parts and manufacturing costs of the chair. Craftsman are required to hand-cut each piece while also working around the imperfections contained within the wood. The chair frame is assembled in a piece-by-piece fashion which typically requires gluing and doweling to create high strength wooden joints. Additionally, clamping and a setting time of several hours for the glue is required at each successive stage of the chair frame assembly. Thus, while traditional manufacturing techniques produce high quality chair frames, this quality standard is achieved through increased expenses, longer assembly time, and requires substantial quantities of unfinished work in progress.

These traditional methods also require the chair frame to be completed prior to outfitting the frame with seat and back springs, stuffing and final upholstery. The production process furthermore usually involves a stationary assembly location to which individual parts must be transported, or a moving assembly line which carries the chair frame through the various assembly locations; thus requiring a large amount of manufacturing floor space. The completion time for a finished chair manufactured according to these traditional methods can range from several days to several weeks. These methods also require complex and inflexible production schedules and increased retooling and changeover times.

While many stylized occasional chairs will require custom made integrated chair frames manufactured using conventional assembly techniques, furniture manufacturers are continually striving to develop modular chair frames assembled from universal and/or interchangeable structural components. These structural components can be manufactured from low-cost materials such as plywood or fiber board thereby reducing the amount of expensive furniture grade hardwoods. Furthermore, there is a continuing desire to develop improved fabrication and production techniques which will result in reduced costs while promoting increased efficiency and improved product quality.

SUMMARY OF THE INVENTION

In accordance with the principles of the present invention, an improved modular occasional chair assembled from a universal seat deck and preupholstered components is disclosed. Additionally, an improved method for manufacturing a modular article of furniture is disclosed which is designed to overcome the disadvantages traditionally associated with fabricating, assembling and upholstering traditional occasional chairs. Therefore, a primary object of the present invention is to provide a modular chair which can be simply, efficiently, and rigidly assembled from interlocking frame components so as to eliminate the need for an integrated chair frame, and to significantly reduce its overall complexity, weight, and cost while providing a high-quality occasional chair which is comfortable to the seat occupant.

It is an additional object of the present invention to provide a modular chair formed from preassembled and preupholstered modular components. The present invention provides a universal seat deck formed by securing individual hardwood rail members into a rectangular frame with a universal corner bracket which eliminates the need for gluing and doweling the abutting hardwood rails. As such, the present invention provides a rigid seat deck to which additional modular components are attached during the assembly process. The modular components then dictate the "style" or design aesthetics of the chair. These modular components, such as, the side frame and seat back assemblies can be quickly assembled from pre-cut plywood p arts secured with fast drying "bullet" glue and various length staples.

It is another object of the present invention to provide a universal seat frame which can accommodate a variety of functional base units, for example, a traditional four-leg base, glider base, swivel base, and swivel/rocker base. Additionally, the style of the chair can be altered by merely changing the styling of the modular side frame panels and modular seat back assemblies which are attached to the seat deck.

It is still another object of the present invention to provide a simplified modular chair frame which is structurally rigid, easy to assemble, and retains the structural rigidity of traditional integrated frame occasional chairs.

It is yet another object of the present invention to provide a modular chair frame assembled from building materials fabricated out of plywood made from fast growing reforested trees, and/or particle board produced from recycled wood fibers. This technique reduces the consumption of slow growing hardwood trees which are more efficiently used for their decorative qualities. Thus, the structural components which are typically hidden by upholstery can be fabricated from environmentally conscious materials. The use of fabricated wood products not only provides increased strength characteristics at a significantly lower cost, but also allows for frame components which are easier to manufacture because the fabricated wood products are more uniform and require less specialized machining.

Furthermore, the present invention relates to an improved "cell manufacturing" technique which allows for a modular chair comprising individual components to be completely assembled and upholstered in a short amount of time; typically less than three hours. To accomplish this, an individual manufacturing cell, approximately 40'×50' is located in a small portion of the manufacturing facility. Each cell has an assembly team of several members which produce the modular chair in a short amount of time. Due to the modular chair design and production techniques of the present invention, for example, it is estimated that a cell with eight team members could produce as many as fifty completed chairs in one day. For maximum efficiency, each assembly team member is trained to perform all functions within the cell. Furthermore, the cell is prestocked with "kits" of all parts necessary for assembling the chair. The objective of the cell manufacturing concept is to reduce the number of unfinished components waiting in queue. This reduction is achieved as the team members become more efficient. The process begins by assembling each modular frame component as an individual unit which is passed through each cell workstation. Each modular frame component is then either fully or partially upholstered before being passed on to the final assembly stage of production. During final assembly, the preupholstered modular components are secured together to produce a fully assembled occasional chair. A small amount of final upholstery is then required to apply a finishing valance to the chair side frames for covering the securement access areas. Once this is completed, the finished chair is boxed and either shipped or placed within the warehouse inventory. The obvious advantages of this cell manufacturing technique are faster cycle times, reduction of work in progress and the ability to quickly turn around custom-order upholstered furniture in a high volume production setting.

Additional objects, advantages and features of the present invention will become apparent from the following description and appended claims, taken in conjunction with the accompanying drawings.

BRIEF DESCRIPTION OF THE DRAWINGS

FIGS. 1A through 1D are perspective views of exemplary occasional chairs shown with various modular base attachments for providing the appropriate comfort function;

FIG. 2 is an exploded perspective view of an exemplary modular chair of the type shown in FIG. 1A with the upholstery and springs removed from the preassembled components for illustrating their modular and interdependent association with an improved universal seat deck;

FIG. 3A is a plan view of a stamped metal blank used to form a universal corner bracket;

FIG. 3B is a perspective view of the universal corner bracket used in forming the universal seat deck shown in FIG. 2;

FIG. 4A is a plan view of the universal seat deck in accordance with a preferred embodiment of the present invention;

FIG. 4B is a side view of the universal seat deck shown in FIG. 4A;

DETAILED DESCRIPTION OF THE INVENTION

Figure 5:
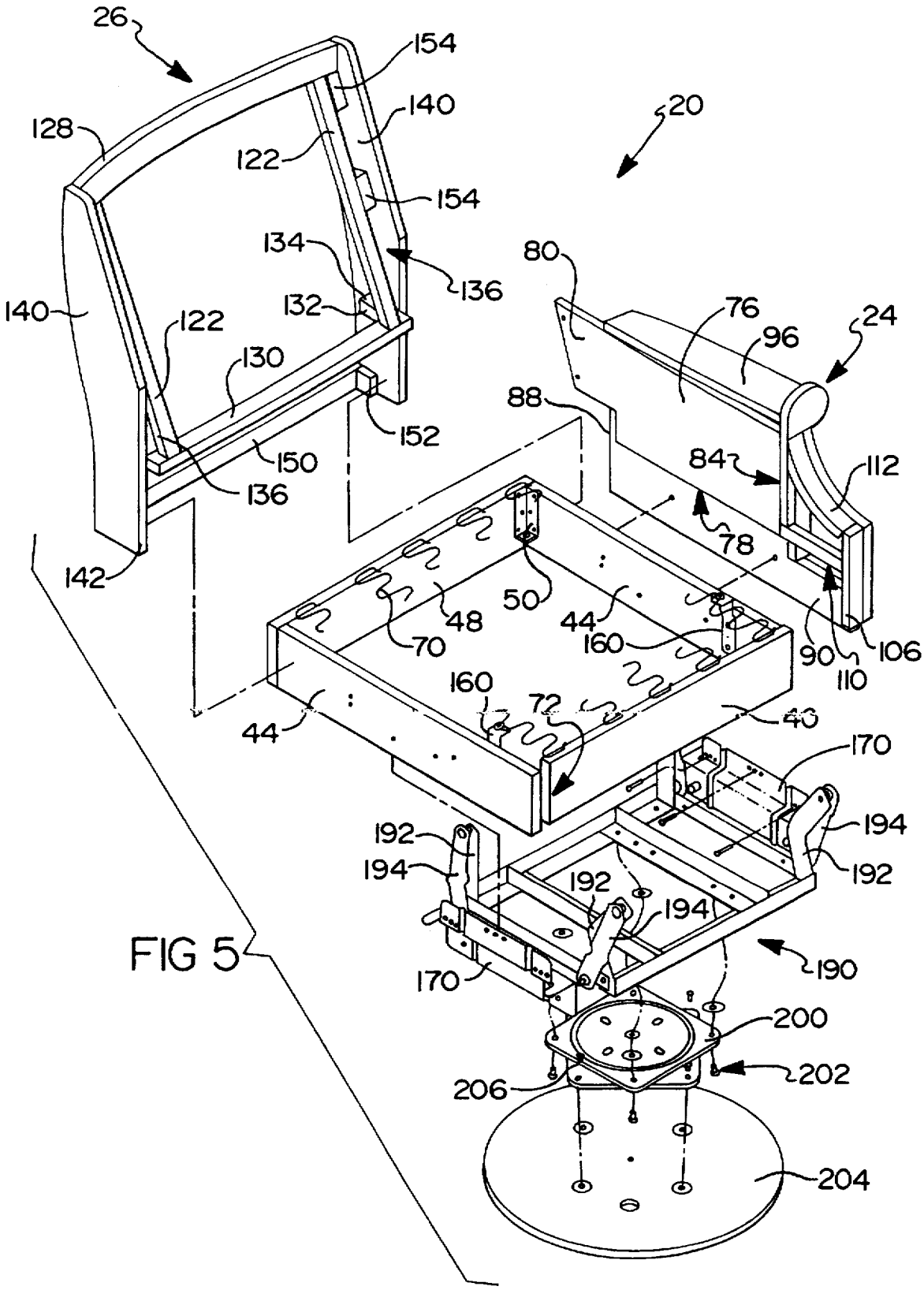
FIG. 5 is an exploded perspective view of a modular chair in conjunction with a glider frame sub-assembly and base.

In accordance with the teachings of the present invention, an improved modular chair frame for assembling various styles of occasional chairs is disclosed. In addition, the present invention is also directed to a method of assembling the improved chair frames from modular, preupholstered components. As will be described, the various styles of modular chair frames are assembled from a common seat deck which can be quickly assembled, sprung and upholstered by way of a universal corner bracket. The preupholstered seat frame provides precise mechanical alignment and superior structural rigidity while facilitating the implementation of highly efficient fabrication and assembly processes.

The modular chair of the present invention can be assembled to form an unlimited variety of occasional chair styles including, but not limited to, a club style chair having four legs, an occasional chair mounted on a swivel base, an occasional chair mounted on a swivel/rocker base, and an occasional chair mounted on a glider or swivel/glider base. An exemplary glider base which is compatible with the modular chair of the present invention is disclosed in U.S. patent application Ser. No. 08/533,829 filed Oct. 18, 1995, entitled "Glider Chair". The above-identified application, which is commonly owned by the assignee of the present invention, is expressly incorporated herein by reference.

In the disclosed embodiment, the article of furniture is shown as an occasional style chair, hereinafter referred to as modular chair 20, which includes a common preupholstered seat deck 22 and various upholstered frame components that can be quickly and simply modularly assembled as a seating unit. Such "modular" construction provides a significant advancement over occasional furniture fabrication and assembly techniques since the assembly of a custom, integrated chair frame is no longer required prior to installation of the upholstery. As such, each modular frame component can be preupholstered prior to assembly with the modular seat deck 22 so as to improve individual component quality, as well as overall system quality and production efficiency. Moreover, since the various styles of modular chair 20 of the present invention are based upon a common seat deck 22, styling variations can be made during a "running change" within the production cycle without changing the production fixtures. Thus, the production method of the present invention enhances the marketing of various styles of low cost modular occasional chairs.

With particular reference now to the drawings, the structural and functional aspects of modular chair 20, shown in various unupholstered styles will now be described. With particular reference to FIGS. 1A through 1D, four styles of occasional chairs are shown in accordance with the preferred embodiment of the present invention. FIG. 1A illustrates modular chair 20 as a club style chair. This exemplary configuration of modular chair 20 includes seat deck 22, with a base assembly 30 having four legs 28. Chair 20 is further defined by its modular stylized components including left and right side frame assemblies 24 and seat back assembly 26. FIG. 1B illustrates modular chair 20 in which seat deck 22 is assembled with a glider base 34. FIG. 1C depicts modular chair 20 wherein seat deck 22 is attached to a spider style swivel base 36. Finally, FIG. 1D shows modular chair 20 in conjunction with a spider style base 38 which provides swivel and rocking motions. It should be particularly noted that seat deck 22 is common to the various style chairs disclosed herein. However, although the illustrations depict modular chair 20 as a wing back style arm chair, a wide variety of other chair styles can be created by simply restyling left and right side frame assemblies 24 and seat back assembly 26 without deviating from the scope of the present invention.

As shown in FIG. 2, modular chair 20 is assembled from interlocking modular components. Seat deck 22 forms the common structural element for all styles of modular chair 20. Seat deck 22 is defined by left and right side rails 44, a rear cross member 48, and a front cross member 40. Although not shown in this perspective view, all four corners of the various cross members and side rails forming the box-like rectangular structure of seat deck 22 are secured by individual universal corner brackets 50. Securement can be achieved using conventional wood screws driven from the inside of seat deck 22 and into the wooden cross members and side rails. Preferably, however, corner brackets 50 are secured with self-tapping metal screws driven from the outside of seat deck 22 and into apertures formed within each metal bracket 50. This preferred method provides for significantly stronger and more rigid joints while eliminating the problem of stripping the bores formed in the wooden frame members often encountered with conventional wood screws. Additionally, wax is applied to the area of each side rail 44 and cross member 40, 48 which engages bracket 50 to prevent squeaking between the metal and unfinished wood surfaces.

To further enhance the rigidity of the joints of the box-like frame, butt ends 46 of left and right side rails 44 engage rear cross member 48 to form a structurally secure "butt joint" at each rear corner of seat deck 22. The forward corner joints of seat deck 22, however, are slightly different from those forming the rear corner joints. As best seen in FIGS. 2 and 4A, when the forward end portions of left and right side rails 44 and the end portions of front cross member 40 are secured by universal corner bracket 50, the butt ends 42 of front cross member 40 and butt ends 46 of left and right side rails 44 form a pair of 90° open joints or front notches 72. These open joints provide a structural enhancing load bearing surface for inside corner 106 of front post 104 which improves the overall structural rigidity of modular chair 20. To further enhance the strength and uniformness of seat deck 22, front and rear cross members 40, 48 and left and right side rails 44 are typically made from various high quality furniture grade hardwoods.

An additional feature of modular chair 20 is that left and right side frame assemblies 24 and seat back assembly 26 can be assembled during parallel assembly processes at separate workstations occurring in conjunction with the assembly of seat deck 22. Side frame assemblies 24 include an inner side frame panel 76 which is secured to an outer side frame panel 86 using a fast drying "bullet" glue or other suitable adhesive along with high strength staples (not shown). This two-layer panel forms the primary structural component of each side frame assembly 24. These components are typically produced from environmentally conscious fabricated wood products such as plywood or fiber board. Side frame assembly 24 is further defined by attaching armrest post 94 to the forward edges 84 of inner and outer side frame panels 76, 86 using staples and bullet glue. Top armrest panel 96 is then applied to the back surface of armrest post 94 and the top edge of outer side frame panel 86. Finally, forward panel assembly 100, which includes forward panel 102, front post 104, universal rail 108, and contoured filler panel 112, is secured to the front surface of armrest post 94 and the forward tab 90 of outer side frame panel 86. Additional styling contour may be provided to left and right side frame assemblies by attaching upper and lower valance filler strips 98 to the outside surface of outer side frame panel 86. The process of assembling left and right side frame assemblies 24 and seat back assembly 26 is such that the construction of the various wooden components does not require any doweling of the glued surfaces, nor clamping the components together while the adhesive dries. Thus, it will become apparent to one skilled in the art that the modular components can be quickly and efficiently assembled while further eliminating "work in progress" within the production line.

With continued reference to FIG. 2, seat back assembly 26 includes an inner seat back frame 120 supported within an outer frame defined by left and right outer wing panels 140 and lower wing panel rail 150. Seat back frame 120 includes a pair of back support uprights, each having an upper notch 124 for receiving the inside lower corner and edge of seat back top rail 128, and a lower notch 126 for receiving the back corner and top edge of seat back lower rail 130. Back support uprights 122 are laterally-spaced at opposite ends of seat back top rail 128 and seat back lower rail 130, thereby forming seat back frame 120. A pair of left and right outer wing panels 140 are secured to the butt ends of seat back top rail 128, seat back lower rail 130 and lower wing panel rail 150 using staples and bullet glue. The structural integrity of seat back assembly 26 is further enhanced by spacer blocks 154 secured at two locations between each back support upright 122 and each outer wing panel 140. Additionally, the butt joint between the lower wing panel rail 150 and each outer wing panel 140 is enhanced with a pair of reinforcing blocks 152. A pair of attachment blocks 132 are attached to an inside surface 146 of each left and right outer wing panel 140 which create an additional load bearing surface for engaging the lower edge formed on rear tab 80 of inner side frame panel 76. A rectangular space 136 is defined by top surface 134 of each attachment block 132, spacer block 154, inside surface 146 and back support upright 122 for receiving rear tab 80 of inner side frame panel 76, thereby creating a modular, yet interlocking chair frame. To provide seat back 26 with enhanced rigidity, a pair of T-nuts 144 are inserted into bores formed on the outside surface of left and right outer wing panels 140.

After a short setting time for the bullet glue has elapsed, the individual modular components are upholstered and secured to seat deck 22 thereby forming modular chair 20. To form a more rigid structure, left and right side frame assemblies 24 are secured to each corresponding left and right side rail 44 such that the lower edge 78 of inner side frame panel 76 abuttingly engages the top surface of each side rail 44. Further, each inside corner 106 of front post 104 is firmly secured within front notches 72 formed by the butt ends 42 and 46 of front cross member 40 and side rails 44. Left and right side frame assemblies 24 are secured with suitable fasteners which extend through bores formed in each side rail 44, and through apertures formed within inner and outer side frame panels 76 and 86, into T-nuts 144 fitted within bores placed in the outside surface of outer side frame panel 86. Securing seat back assembly 26 to modular chair 20 involves interlocking each rear tab 80 of each inner side frame panel 76 into space 136, which serves to lockingly engage these modular components. Additionally, the configuration is such that forward edge 142 of left and right outer wing panels 140 abuttingly engage rear edge 88 of outer side frame panel 86. Securement of these components is completed by placing suitable fasteners through rear tab 80 and into T-nuts 144 previously installed within each outer wing panel 140.

Thus, from the above description and Figures referenced therein, it should be apparent to one skilled in the art that the present invention not only allows the modular preupholstered components to be assembled in an interlocking fashion from low cost, high strength wood materials, but further provides a configuration in which the number of integrally formed load bearing surfaces are maximized to enhance the structural rigidity of the modular chair 20.

Referring now to FIG. 3, a universal corner bracket 50 is disclosed in accordance with the preferred embodiment of the present invention. Universal corner bracket 50 includes a first flange surface 52 having a perpendicular first tab surface 58 formed at its lower end, and a second flange surface 54 which is perpendicular to the first flange surface 52. Second flange surface 54 also has a perpendicular second tab surface 60 formed at its lower end. Thus, first tab 58 and second tab 60 overlap one another to form a third orthogonal flange surface 62 having an aperture 64 formed therein. Additionally, each flange 52, 54 has a series of three apertures 55 formed therein for receiving suitable fasteners 66, including, but not limited to self-tapping metal screws. Furthermore, an aperture 64 is formed in third orthogonal flange surface 62 and is positioned for receiving a threaded screw secured within each chair leg 28. Universal corner bracket 50 can be efficiently stamped from a single sheet of a suitable material such as, but not limited to, steel. The process involves forming a slot 56 within the steel blank which extends vertically through the middle from the lower edge approximately ⅕ to ¼ of the way toward the top of the steel blank. The blank is then bent along a bisecting line running from the top of slot 56 to the top portion of the blank, thereby forming first flange 52 and second flange 56 which are perpendicular to one another. Next, the lower portion of first flange 52 is then bent upwardly to form first tab 58. Finally, the lower portion of second flange 54 is bent upwardly and directly beneath first tab 58 to form a second tab 60. Thus, the formation of slot 56 allows universal corner bracket 50 to have three orthogonal load bearing surfaces formed from a single blank. Additionally, when a chair leg 28 is not being secured through aperture 64 formed in third flange surface 62, first tab 58 and second tab 60 can be secured to one another with a suitable fastener, or by welding, thereby providing additional rigidity to corner bracket 50. Thus, seat deck 22 can be assembled quickly and efficiently by securing left and right side rails 44 with front cross member 40 and rear cross member 48 to form a box-like structure with rigid joints while eliminating the traditional method of gluing doweling, and clamping.

Upon completing the construction of seat deck 22, spring retaining brackets 68 can be immediately applied to the top edges of front cross member 40 and rear cross member 48 since the curing time for any glue has been eliminated. Upon completion of this operation, seat deck 22 can be "sprung" by stretching sinuous seat springs 70 between the front and rear spring retaining brackets 68. The modular seat deck 22 is then ready for upholstery and final assembly with the remaining modular components.

As best seen in FIG. 4B, front cross member 40 of seat deck 22 is mounted approximately one inch above the plane formed by the top edges of left and right side rails 44 and rear cross member 48. The "seat pitch" angle 74 is represented by the notation e and is also a unique enhancement which provides modular chair 20 with the additional comfort feature expected of a high quality article of furniture. One skilled in the art will readily see that varying pitch angle 74 to adjust the "feel" of modular chair 20 is within the scope of the present invention.

Figures 6A, 6B, 6C, 9:
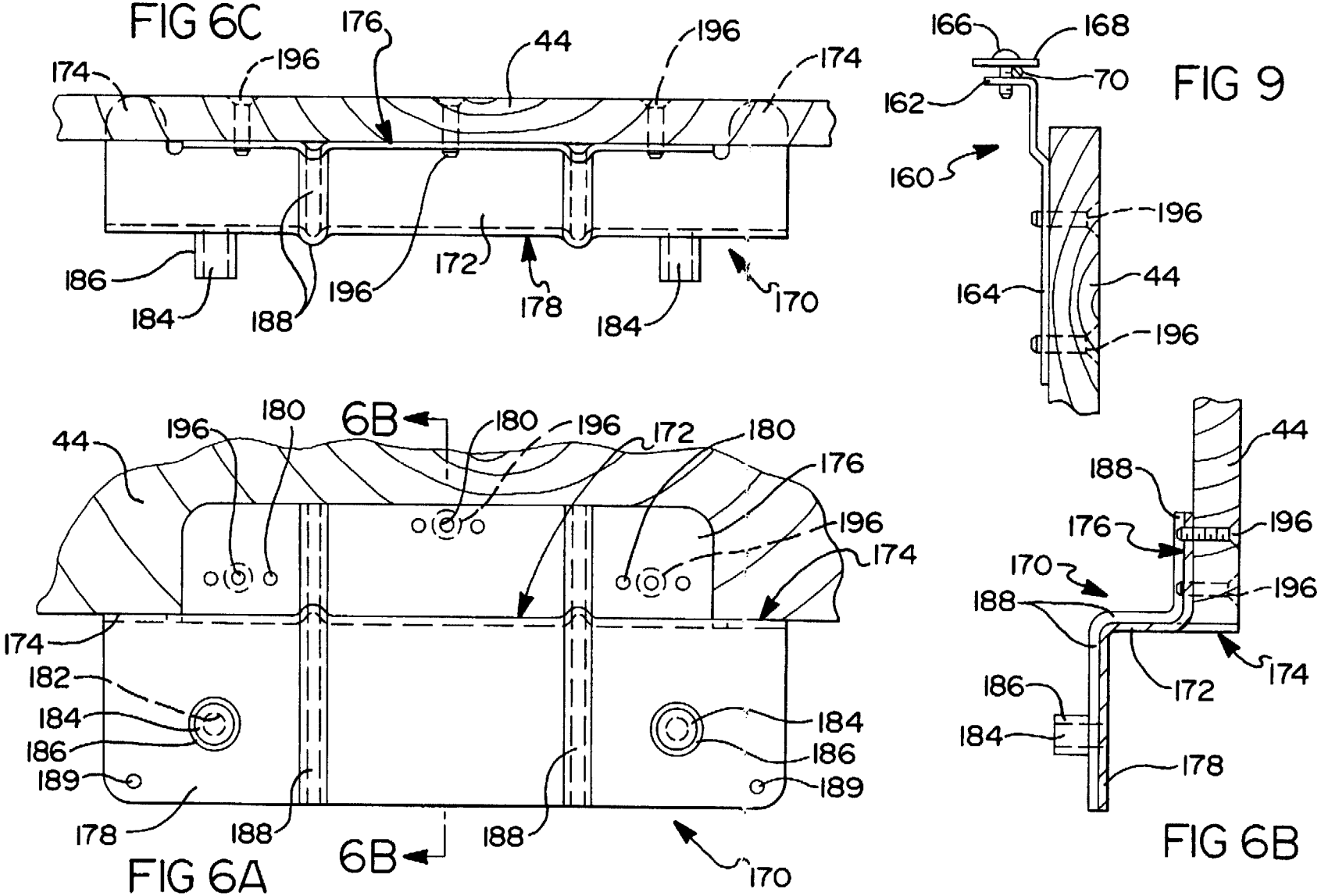
FIG. 6A is a side view of a universal glide mount bracket in accordance with a preferred embodiment of the present invention.
FIG. 6B is a sectional view taken along line 6B—6B of the glide mount bracket depicted in FIG. 6A.
FIG. 6C is a plan view of the glide mount bracket as illustrated in FIG. 6B.
FIG. 9 is a side view of a spring support bracket in accordance with a preferred embodiment of the present invention.

With particular reference to FIG. 5, an alternative preferred embodiment of the present invention is disclosed. Modular chair 20 can easily take the form of an occasional glider chair, similar to that shown in FIG. 1B, simply by attaching a high quality yet modular base glide assembly 190 to the lower portion of seat deck 22 by way of universal glide mount bracket 170. Base glide assembly 190 is similar and/or identical to that disclosed in U.S. patent application Ser. No. 08/533,829 filed Oct. 18, 1995, entitled "Glider Chair", and further disclosed in U.S. Continuation-in-part patent application Ser. No. 08/633,626 filed Apr. 17, 1996, entitled "Glider Chair", the disclosures of which are expressly incorporated herein by reference. The rigid base glide assembly 190 supports four front and rear glide uprights 192 which are pivotably coupled via bearing assemblies at a top portion of each glide upright 192 to the front and rear glide links 194. The lower portion of each glide link 194 is in turn pivotably secured via bearing assemblies to apertures 189 formed within each universal glide bracket 170. As best seen in FIGS. 5 and 9, when seat deck 22 is used in conjunction with base glide assembly 190, each side rail 44 is fitted with an L-shaped spring support bracket 160 having a horizontal flange 162 which is perpendicular to its vertical flange 164. The vertical flange 164 of spring support bracket 160 is secured to the inside surface of each side rail 44 using self-tapping metal screws 196 driven from the outside of each side rail 44. These self-tapping screws have a modified head which countersinks itself flush with the outside surface of each side rail 44. Additionally, wax is applied to the area of side rail 44 which engages vertical flange 164 to prevent squeaking between the metal and unfinished wood surfaces. Referring briefly to FIG. 9, the horizontal flange 162 of spring support bracket 160 contains an aperture for securing a self-tapping threaded fastener 166 and a retaining washer 168 which serve to clamp a portion of the outer sinuous seat spring 70 and prevent the spring from interfering with the front glide uprights 192. Referring back to FIG. 5, by supporting and securing outer seat springs 70 with support brackets 160, longer front glide uprights 192 and longer glide links 194 can be used with seat deck 22. The enhancement of longer front glide uprights 192 and longer glide links 194 provides for a glider chair with a smoother and flatter glide motion, a comfort quality which distinguishes over conventional occasional glider chairs. Base glide assembly 190 can also be secured to the swivel plate 200 of a swivel assembly 208 using suitable fasteners. Mounting plate 222 of swivel assembly 208 is then in turn secured to base 204. Thus, this embodiment provides a modular occasional chair 20 with both a gliding motion and a swivel motion. Although not shown, base glide assembly 190 is also capable of mounting directly to base 204 to provide a modular occasional chair 20 with only a gliding motion.

Referring now to FIG. 6, an improved glide mount bracket 170 is disclosed which facilitates the use of a universal seat deck 22 with modular base glide assembly 190. Glide mount bracket 170 is stamped from a single metal blank, preferably steel, having a pair of vertical ribs 188 formed therein. These ribs 188 provide additional stiffness to bracket 170 and eliminate undesired flexing of its load bearing surfaces. As best seen in FIG. 6B, glide bracket 170 includes a horizontal surface 172 and a pair of horizontal tabs 174 extending from horizontal surface 172. A vertical flange 176 extends perpendicularly upward from horizontal surface 172, and a lower offset vertical flange 178 extends downwardly from horizontal surface 172, also in a perpendicular fashion. Horizontal tabs 174 enhance the stability and rigidity of lower offset vertical flange 178, and further support the load bearing down upon each bracket 170. As best seen in FIG. 6A, vertical flange 176 contains three sets of adjusting apertures 180 formed therein which correspondingly align with three apertures formed in each side rail 44. Apertures 180 allow the balance point of each modular chair 20 to be adjusted in relation to base glide assembly 190 according to the chair's styling and balance requirements. Lower offset vertical flange 178 also contains a pair of large apertures 182 through which front and rear glide stops 184 are secured. Front and rear glide stops 184 can be optionally outfitted with replaceable rubber covers 186 which prevent metal to metal contact between front and rear glide links 194 and front and rear glide stops 184. Lower offset vertical flange 178 also includes a pair of smaller apertures 189 which are pivotably securable to the lower ends of front and rear glide links 194. Glide brackets 170 additionally provide a preloading force to reduce tolerance stacks in the bearing assemblies of front and rear glide links 194 and eliminate noise and extraneous movements of the chair during the glide motion. Referring now to FIG. 6C, the top view of glide bracket 170 clearly depicts the pair of horizontal tabs 174 which extend from horizontal surface 172. As shown in FIG. 6B, a glide mount bracket 170 is secured to a lower portion of side rail 44 with self-tapping metal screws 196 which are also driven from the outside surface of side rail 44 and into apertures 180. Vertical flange 176 engages the inside surface of side rail 44, and horizontal tabs 174 engage the lower edge of each side rail 44 for additionally supporting load bearing down on bracket 170. Thus, glide bracket 170 can be rigidly secured to each side rail 44 while significantly reducing the shear forces applied to fasteners 196, and eliminating the problem with conventional wood screws stripping out their wooden bores. Additionally, wax is applied to the area of side rail 44 which engages vertical flange 176 to prevent squeaking between the metal and unfinished wood surfaces.

Figure 7:
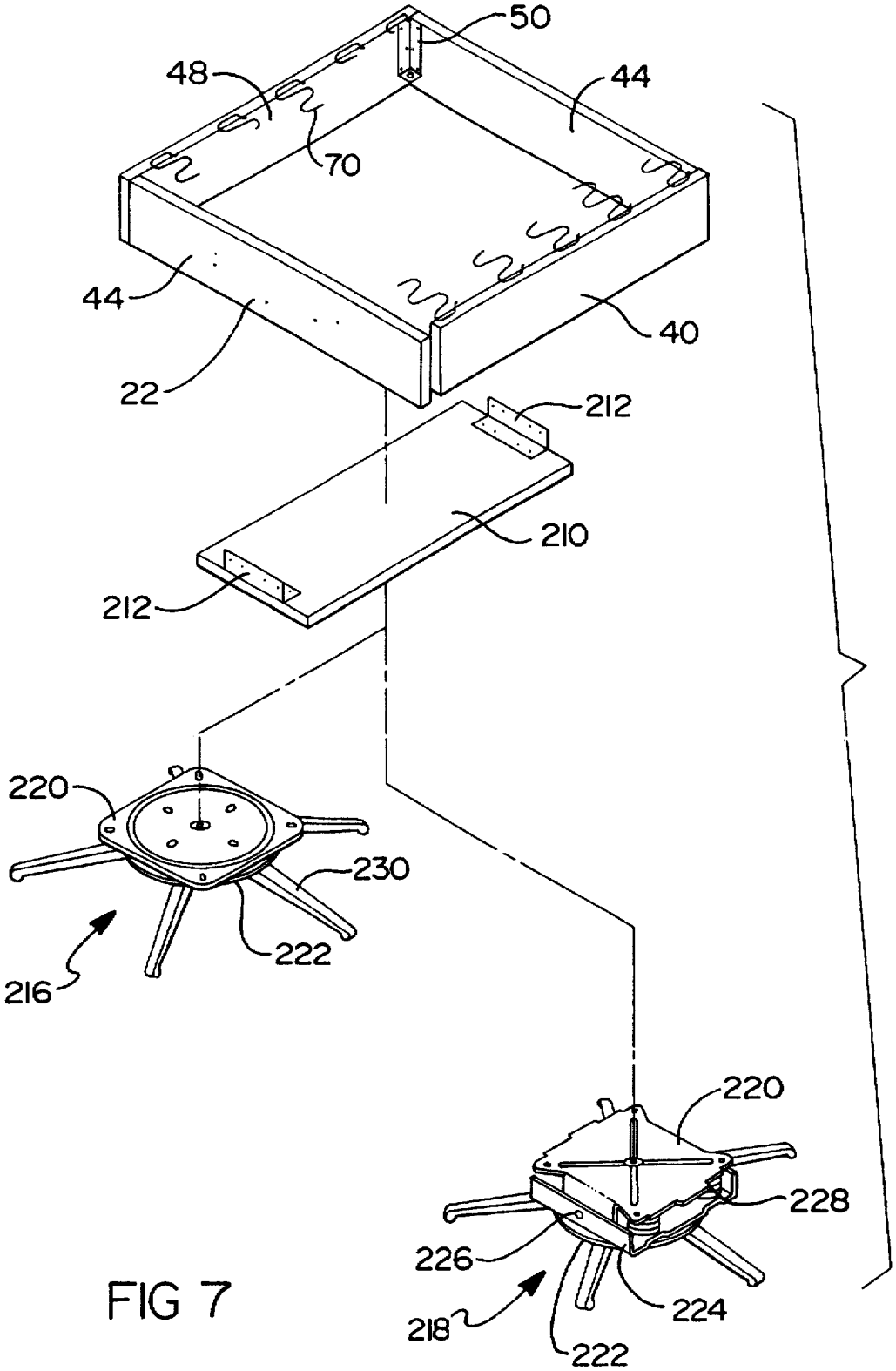
FIG. 7 is an exploded perspective view of the modular chair frame depicting the interchangability of the spider style bases for incorporating swivel or swivel/rocker functions into an occasional chair in accordance with an additional preferred embodiment of the present invention.

Referring now to FIG. 7, two additional preferred embodiments of modular chair 20 are disclosed. Seat deck 22 can additionally be outfitted with a spider base panel 210 using a pair of angle brackets 212 which are secured to the inside lower surfaces of each side rail 44 with self-tapping metal screws as previously disclosed herein. With spider base panel 210 in place, a suitable spider base can be attached thereto which provides either a swivel motion such as that of swivel base 216, or a swivel and rocking motion, such as that provided by swivel rocker base 218. A preferred swivel rocker base is that available from the Hickory Spring Company, Part No. 6011-505-3RS, which includes five legs configured in a spider arrangement, having a mounting plate 222 secured thereto. Rocker block 224 is held in swiveling engagement with mounting plate 222 via an axle pin (not shown). Rocker block 224 also connects to upper swivel plate 220 with a pair of pivot pins 226. When springs 228 are used in conjunction with rocker block 224, a fore and aft rocking motion is provided to seat deck 22 and thus modular chair 20.

Additionally, swivel rocker base 218 can be substituted with swivel base 216. As seen from the drawings, swivel base 216 possesses a similar five-leg spider style layout. However, legs 230 are slightly inclined to compensate for the absence of rocker block 224. Thus, a modular chair 20 assembled with swivel base 216 can also provide the desired swivel motion as a comfort feature.

In accordance with the principles of the present invention, a unique method for assembling the various "modular" preassembled and preupholstered frame components onto seat deck 22 of modular chair 20 will now be described in greater detail. In addition, the "cell manufacturing" process of the present invention will also be disclosed which permits assembly of the modular preassembled and/or preupholstered components in a simple and efficient manner. This process provides for significantly reducing overall system complexity, production cycle time, and production cell retooling time, while promoting superior quality and reliability of modular chair 20.

Figure 8:
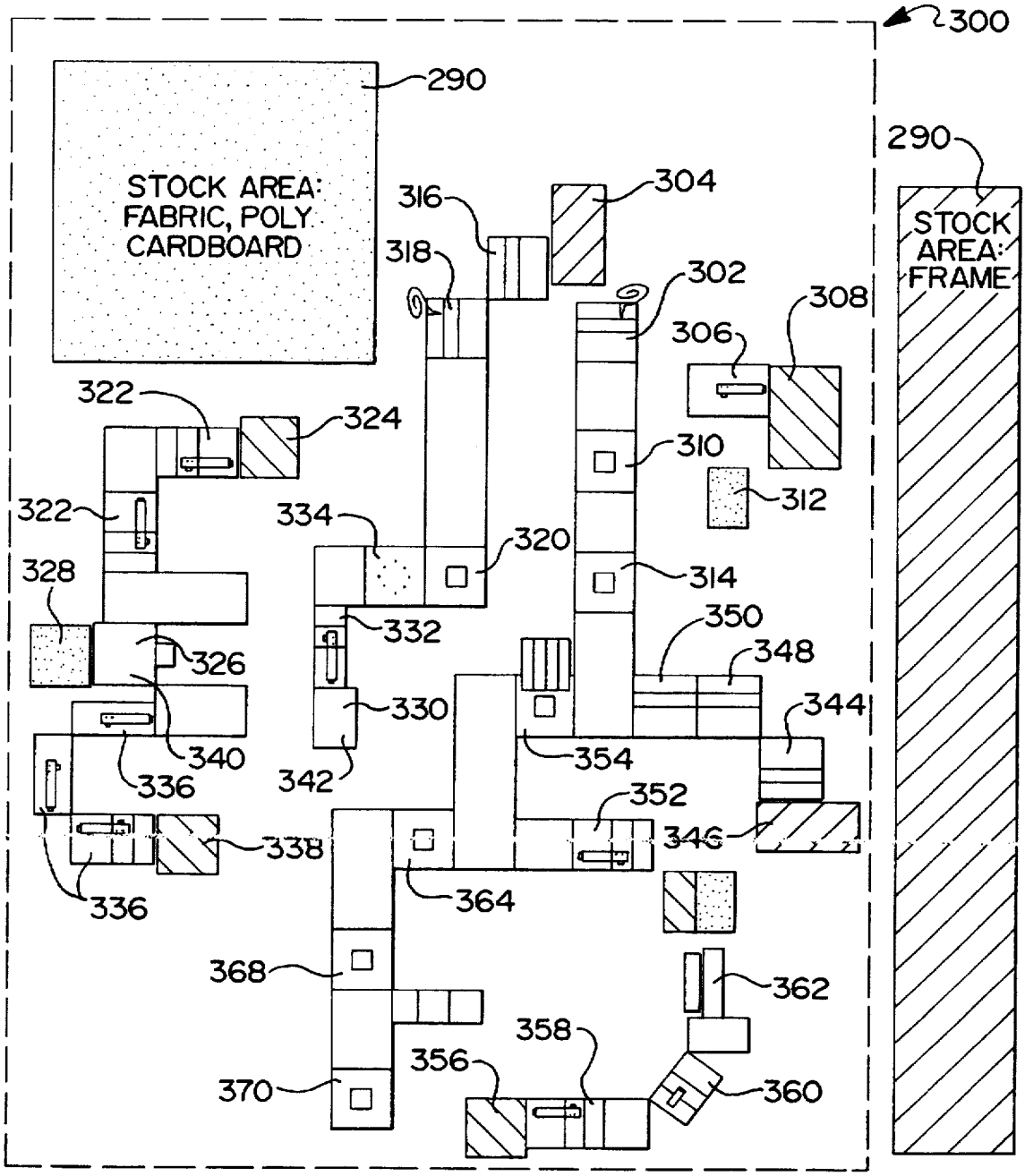
FIG. 8. is a diagram illustrating the layout of an exemplary cell manufacturing environment used with an assembly method in accordance with a preferred embodiment of the present invention.

Referring now to FIG. 8, a manufacturing cell layout for modular chair 20 is disclosed. The manufacturing "cell" 300 is defined by an area of approximately 40 feet by 50 feet, and therefore, as presently disclosed, occupies a relatively small area of the total manufacturing facility. The entire assembly process for producing an article of furniture, including a modular chair 20, occurs within the cell. At the periphery of the cell are predetermined stock areas 290 for the various precut parts which are assembled, combined, and/or sewn to produce a chair. All of the precut parts for each modular component are stored together as a single "kit", and the kits are pulled one at a time for assembly at the various stations located within the cell.

The goal of the cell manufacturing technique is to significantly reduce the amount of work in progress, and the amount of work waiting in queue between stations. Thus, as the team members working together in the cell become fully trained in performing all functions within the cell, their efficiency increases, and the goals of the cell manufacturing technique are achieved. Ultimately, when the cell is operating at peak efficiency, only one article of furniture is manufactured at a time within the cell, and no work begins on a new article of furniture until the previous article is completed and boxed.

The cell manufacturing technique involves multiple concurrent subassembly processes. Recognizing that some subassembly processes require less time than others, the team members begin their assigned tasks at the start of one production cycle. When the tasks which take less time are complete, those team members who have completed their initial task move along to another station to assist in completion of other tasks, or to begin a new task down stream in the production cycle relating to the same article of furniture. The cell manufacturing technique is to be distinguished from conventional manufacturing techniques where one person works at one station and fills up a queue of subassembly parts which feeds the main assembly line. Thus, the cell disclosed does not have a main assembly line. All modular components are assembled at various locations within the cell, are passed on to subsequent stations for additional work, and finally come together at a station very close to the end of the assembly process for executing the final assembly and completion of the modular chair.

In cell 300, a modular chair 20 is assembled from modular, preassembled and preupholstered components, namely, a modular universal seat deck 22, the appropriate base assembly 30, and the stylized modular components including a pair of side frame assemblies 24, and a seat back assembly 26. As previously stated, one goal of the method of the present invention is to begin assembling one article of furniture and continue this assembly through completion before any work begins on a new article of furniture.

It is to be understood from the following description that the concurrent subassembly processes begin at various stations within the cell at the start of one production cycle, and continue as parallel processes. For example, at station 302 depicted in FIG. 8, left and right side frame assembly kits are pulled from the adjacent frame supply area 304. The precut wooden frame parts are quickly assembled with bullet glue and staples to produce individual left and right side frame assemblies 24, which are then moved to station 310. Likewise, at station 306, side frame upholstery kits are pulled from fabric supply area 308, and the sewing process is executed for the precut fabric pieces. At station 310, a polyester stuffing kit is pulled from poly supply area 312, and the team member attaches the stuffing to each of the side frame assemblies 24, which are again moved to station 314 once complete. By this time, the sewing process at station 306 is complete, and the fabric is applied to each side frame assembly during the upholstery process at station 314. Once upholstered, the modular left and right side frame assemblies 24 are complete and ready for final modular assembly at station 364.

Occurring as a simultaneous process at station 316, a seat back kit is pulled from frame supply area 304 and is quickly constructed to form a modular seat back assembly 26. The assembly is then passed to station 318, where the springs are attached to the seat back assembly 26, which is then passed to station 320. Likewise, a seat back cushion (not shown) is constructed and sewn at stations 322 from a fabric kit pulled from fabric supply are 324, stuffed at station 326 with a poly stuffing kit pulled from poly supply area 328, checked for quality at station 330, sewn closed at station 332, buttoned, if applicable, at station 334, and finally secured to the presprung seat back frame at station 320, thereby producing and upholstered modular seat back assembly 26. Also simultaneous to this process, a seat cushion (not shown) is constructed and sewn at stations 336 from a fabric kit pulled from fabric supply area 338, stuffed at station 340 with a poly kit pulled from supply area 328, and checked for quality at station 342. The modular seat cushion is now also ready for final assembly with the other modular components.

Also occurring as a simultaneous process, seat deck 22 is assembled from a frame kit pulled from frame supply area 346. At station 344, spring clips 68 are applied to front and rear cross members 40, 48. Next, at station 348, side rail members 44 and cross frame member 40, 48 are assembled into the rigid box-like frame forming seat deck 22 using universal corner brackets 50, and sinuous seat springs 70 are applied at station 350. To complete the construction of modular seat 22, the fabric for the seat upholstery is sewn at station 352, and is then applied to seat deck 22 at upholstery station 354. To finalize this assembly, the appropriate base is secured to seat deck 22.

Occurring as an additional simultaneous process, finishing fabric pieces comprising the valance (not shown) are pulled as a kit from supply area 356, and assembled and sewn at stations 358, 360, and 362. Upon completion of these subassembly steps, the valance is complete and ready for the final upholstery process.

Station 364 is the final modular assembly station, and is where all of the completed modular components are assembled into modular chair 20. The modular components, including upholstered seat deck 22, upholstered left and right side frame assemblies 24, and upholstered seat back assembly 26 are finally assembled. As best disclosed in FIG. 2, the process includes interlocking rear tab 80 of each side frame assembly 24 within space 136 of seat back assembly 26. These three modular components are then secured with suitable fasteners. This subassembly is then placed upon seat deck 22 such that the lower edge 78 of each side frame assembly 24 engages the top surface of each side rail 44, and the inside corner 106 of each side frame assembly 24 engages its respective front notch 72 of the seat deck 22. Each side frame assembly 24 is then secured to its respective side rail 44 with suitable fasteners which engage T-nuts 144. Finally, the seat cushion is fitted on top of seat deck 22.

Once the final assembly of modular chair 20 is completed at station 364, the final upholstery is applied to the areas of the modular chair 20 which could not be previously upholstered. The finishing steps to conceal the securement access areas are performed at stations 366 and 368. The modular chair is now completely assembled and can be passed to station 370 where the article of furniture is inspected for quality, boxed and shipped to a customer or placed within the warehouse inventory. Accordingly, one skilled in the art will readily understand that it is within the scope of the cell manufacturing technique disclosed herein to produce a modular article of furniture in nearly an unlimited number of styles, simply by changing the styling of the various modular components. Thus, the cell manufacturing technique and the universal seat deck 22 of the present invention allow for significant efficiencies to be achieved in the manufacturing environment while providing the flexibility of manufacturing custom-order articles of furniture from a modular frame in a highvolume production environment.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A modular chair comprising:

a seat deck having a pair of laterally spaced side rails abuttingly engaging a rear cross member, and interconnected to a front cross member;

bracket means for securing said side rails to said rear cross member at a rear portion of said seat deck, and for securing said side rails to said front cross member;

a base operably interconnected to said seat deck;

a left side frame assembly and a right side frame assembly for engaging said side rails of said seat deck, each of said side frame assemblies forming an individual modular component; and a seat back assembly for engaging said seat deck and said side frame assemblies, said seat back assembly forming an individual modular component;

said left and right side frame assemblies including an inner side frame panel having a horizontal ledge formed on a lower surface thereof for engaging a top surface of said side rails, and a rearwardly extending tab for engaging a rectangular space defined in said seat back assembly;

whereby said side frame assemblies and said seat back are operably interconnected with said seat deck and said base for creating an interlocking engagement for enhancing the structural integrity of said modular chair.

2. The modular chair of claim 1, wherein said seat deck forms a rectangular box-like frame structure.

3. The modular chair of claim 2, wherein the interconnection between said front cross member, said bracket means, and said side rails form a pair of vertical notches at the outside front corners of said seat deck.

4. The modular chair of claim 3, wherein a top edge of said front cross member extends above a horizontal plane formed by said side rails and said rear cross member, thereby forming an inclined seating surface.

5. The modular chair of claim 4, wherein said bracket means comprises a first flange surface having a perpendicular first tab surface extending therefrom and a second flange surface having a second tab surface extending therefrom, wherein said first flange surface and said second flange surface are perpendicular, and wherein said first tab surface is positioned directly above said second tab surface, whereby said first tab surface, said second tab surface, and said first and second flange surfaces are orthogonal.

6. The modular chair of claim 5, wherein said first tab surface is fixedly secured to said second tab surface.

7. The modular chair of claim 5, wherein said first and second flange surfaces have a plurality of apertures formed therein for receiving fastener means for securing said bracket means to said seat deck.

8. The modular chair of claim 7, wherein said bracket means is constructed from a one-piece metal blank having a bisecting slot formed therein.

9. The modular chair of claim 7, wherein said first and second tab surfaces include an aperture formed therein for receiving a fastener.

10. The modular chair of claim 9, wherein a chair leg is secured to said fastener.

11. The modular chair of claim 1, wherein said seat deck comprises a plurality of spring clips secured along a top edge of said front cross member and secured along a top edge of said rear cross member, said seat deck having a plurality of seat springs attached between said spring clips to form a seat surface.

12. The modular chair of claim 11, wherein said seat surface and said front and rear cross members of said seat deck are upholstered to form an individual modular component.

13. The modular chair of claim 1, wherein said left side frame assembly, said right side frame assembly, and said seat back assembly are individually upholstered prior to being operably interconnected with said seat deck.

14. The modular chair of claim 13, wherein said base comprises a glider mechanism secured to a swivel base thereby allowing said modular chair to rotate about a vertical axis and glide fore and aft along a longitudinal axis, said glide mechanism being secured to said seat deck by a universal glide bracket.

15. The modular chair of claim 14, wherein said universal glide bracket is stamped from a single metal blank and includes a horizontal surface having a vertical flange perpendicularly extending therefrom, and a lower offset vertical flange extending perpendicularly downward therefrom, said horizontal surface further including tab means for supporting a lower edge of said side rail.

16. The modular chair of claim 13, wherein said seat deck includes a horizontal and laterally positioned panel secured between said side rails for supporting said modular chair on said base.

17. The modular chair of claim 16, wherein said base includes a swivel base.

18. The modular chair of claim 16, wherein said base includes a swivel rocker base.

19. A modular chair comprising:

a seat deck including a pair of laterally spaced side rails interconnected to a front cross member to form a pair of front corners, and interconnected to a rear cross member to form a pair of rear corners;

a left side frame assembly and a right side frame assembly for engaging said side rails;

a seat back assembly for engaging said seat deck and said side frame assemblies;

said left and right side frame assemblies including an inner side frame panel having a horizontal ledge formed on a lower surface thereof for engaging a top surface of said side rails, and a rearwardly extending tab for engaging a rectangular space defined in said seat back assembly; and a bracket disposed in an inside portion of each of said front corners for securing said side rails to said front cross member;

said bracket including a first flange surface having a perpendicular first tab surface extending therefrom and a second flange surface having a second tab surface extending therefrom, wherein said first flange surface and said second flange surface are perpendicular, and wherein said first tab surface is positioned directly above said second tab surface to form a third flange surface, whereby said first flange surface, said second flange surface, and said third flange surfaces are orthogonal.

20. The modular chair of claim 19, wherein said first and second flange surfaces have a plurality of apertures formed therein for receiving fastener means for securing said bracket to said seat deck.

21. The modular chair of claim 19, wherein said bracket is constructed from a one-piece metal blank having a bisecting slot formed therein.

22. The modular chair of claim 19, wherein said first and second tab surfaces include an aperture formed therein for receiving a fastener.

23. The modular chair of claim 19, wherein said seat deck forms a rectangular box-like frame structure.

24. The modular chair of claim 23, wherein the interconnection between said front cross member, said bracket, and said side rails form a pair of vertical notches at an outside portion of said front corners of said seat deck.

25. The modular chair of claim 24, wherein a top edge of said front cross member extends above a horizontal plane formed by said side rails and said rear cross member, thereby forming an inclined seating surface.

26. The modular chair of claim 19, wherein said bracket is constructed from a one-piece metal blank having a bisecting slot formed therein.

27. The modular chair of claim 26, wherein said first and second flange surfaces have a plurality of apertures formed therein for receiving fastener means for securing said bracket to said seat deck.

28. The modular chair of claim 27, wherein said first tab surface is fixedly secured to said second tab surface.

29. The modular chair of claim 27, wherein said first and second tab surfaces include an aperture formed therein for receiving a fastener.

30. A modular chair comprising:

a seat deck having a pair of laterally spaced side rails abuttingly engaging a rear cross member, and interconnected to a front cross member, wherein a top edge of said front cross member extends above a horizontal plane formed by said side rails and said rear cross member, thereby forming an inclined seating surface;

bracket means for securing said side rails to said rear cross member at a rear portion of said seat deck, and for securing said side rails to said front cross member, said bracket means including a first flange surface having a perpendicular first tab surface extending therefrom and a second flange surface having a second tab surface extending therefrom, wherein said first flange surface and said second flange surface are perpendicular, and wherein said first tab surface is positioned directly above said second tab surface, whereby said first tab surface, said second tab surface, and said first and second flange surfaces are orthogonal;

said interconnection between said front cross member, said bracket means, and said side rails forming a pair of vertical notches at the outside front corners of said seat deck;

a base operably interconnected to said seat deck;

a left side frame assembly and a right side frame assembly for engaging said side rails of said seat deck, each of said side frame assemblies forming an individual modular component; and a seat back assembly for engaging said seat deck and said side frame assemblies, said seat back assembly forming an individual modular component;

whereby said side frame assemblies and said seat back are operably interconnected with said seat deck and said base to form said modular chair.

* * * * *

UNITED STATES PATENT AND TRADEMARK OFFICE

CERTIFICATE OF CORRECTION

PATENT NO. : 5,795,028

DATED : August 18, 1998

INVENTOR(S) : Ralph J. Dussia, Jr., et al.

It is certified that error appears in the above-indentified patent and that said Letters Patent is hereby corrected as shown below:

On the Title Page under U.S. Patent Documents, reference 5,120,107; Notice of References cited attached to Office Action dated 10/9/97, item "H"; "Rogens, Jr." should be --Rogers, Jr.";

Column 2, line 29;
"p arts" should be --parts--;

Column 7, page 67;
"e" should be --e--;

Signed and Sealed this

Twelfth Day of January, 1999

*Attest:*

*Attesting Officer*

*Acting Commissioner of Patents and Trademarks*